US008445817B2

(12) United States Patent
Duchayne et al.

(10) Patent No.: US 8,445,817 B2
(45) Date of Patent: May 21, 2013

(54) DE-ICING OR DEFOGGING SYSTEM FOR OPTICAL INSTRUMENT AND IMAGE ACQUISITION DEVICE PROVIDED WITH SAID SYSTEM

(75) Inventors: Laurence Duchayne, Fronton (FR); Philippe Bramoulle, Muret (FR)

(73) Assignee: Airbus Operations SAS, Toulouse (FR)

( * ) Notice: Subject to any disclaimer, the term of this patent is extended or adjusted under 35 U.S.C. 154(b) by 344 days.

(21) Appl. No.: 12/665,918

(22) PCT Filed: Jun. 19, 2008

(86) PCT No.: PCT/FR2008/051103

§ 371 (c)(1), (2), (4) Date: Jun. 4, 2010

(87) PCT Pub. No.: WO2009/007569

PCT Pub. Date: Jan. 15, 2009

(65) Prior Publication Data

US 2011/0062135 A1 Mar. 17, 2011

(30) Foreign Application Priority Data

Jun. 22, 2007 (FR) ..... 07 55959

(51) Int. Cl.
*H05B 1/00* (2006.01)

(52) U.S. Cl.
USPC ..... 219/201; 219/200; 219/522

(58) Field of Classification Search
USPC ..... 219/201, 202, 209, 200, 522
See application file for complete search history.

(56) References Cited

U.S. PATENT DOCUMENTS

| | | | | |
|---|---|---|---|---|
| 1,848,337 | A | 3/1932 | Franzen | |
| 2,490,433 | A | 12/1949 | Gunning et al. | |
| 4,722,000 | A * | 1/1988 | Chatenever | 348/75 |
| 5,729,003 | A * | 3/1998 | Briggs, III | 235/462.07 |
| 2002/0067424 | A1 | 6/2002 | Brunner | |

OTHER PUBLICATIONS

International Search Report dated Jan. 16, 2009.

* cited by examiner

*Primary Examiner* — Kenneth Parker
*Assistant Examiner* — Yu Chen
(74) *Attorney, Agent, or Firm* — Perman & Green, LLP

(57) ABSTRACT

The disclosed embodiments relate to a defogging or de-icing system for an optical instrument including a protection housing. According to the disclosed embodiments, the system includes: a porthole covered on at least one face thereof with a heat conducting film provided at the edge of the useful area of said porthole, the porthole being mounted on the protection housing, heating members placed in contact with the film for heating said film, and a power supply circuit for the heating members.

9 Claims, 1 Drawing Sheet

DE-ICING OR DEFOGGING SYSTEM FOR OPTICAL INSTRUMENT AND IMAGE ACQUISITION DEVICE PROVIDED WITH SAID SYSTEM

This application is the National Stage of International Application PCT/FR2008/051103 filed 19 Jun. 2008, which claims priority to French Application No. 07 55959 filed 22 Jun. 2007, the disclosures of which are incorporated herein by reference in their entireties.

BACKGROUND

1. Field

The aspects of the disclosed embodiments relate to a de-icing or defogging system for an optical instrument such as an image acquisition device. It also relates to an image acquisition device equipped with such a de-icing and/or defogging system.

The disclosed embodiments apply notably to a camera fitted to an aircraft.

2. Brief Description of Related Developments

It is known to equip airplanes with external cameras in a fixed position for the surveillance of a specific zone of the airplane and/or its environment. These cameras enable the pilot to visualize in real time vital or inaccessible parts of his aircraft such as the wings, undercarriage, cargo hold etc.

As an illustration, such a camera enables, in this way, to visualize precisely the position of the wheels on the runway and any obstacles when the airplane travels along the ground.

However, these cameras are subject to extreme conditions existing outside an airplane at the flying altitude. As an illustration, at 12,000 m altitude, the temperature outside the airplane approaches −50° C. Also, these cameras may be exposed to temperature ranges extending from −55° C. to +70° C. according to the flight phase.

These cameras typically have an image sensor and an objective that are placed inside a protective casing to protect them from ambient conditions, i.e. temperature and humidity.

However, air trapped inside the casing may contain a certain amount of water.

Now, it is observed that when the temperature outside the protective casing falls rapidly, this water rapidly condenses on the coldest part thereof that is often situated in the middle of the porthole or protective glass, placed in front of the optics of the image sensor.

The central part of image is then made unusable. This condensation may moreover cause the quality of the rest of the image generated in this way to deteriorate and in extreme cases make it totally unusable.

In addition, once this condensation has appeared, it may persist over a long period of time even when the conditions that created it no long come together.

Methods are known for a porthole defogging treatment but however these treatments may age with time and the porthole is then found to become opaque, making the image of the sensor blurred.

Finally, it is also known that when an aircraft flies above a certain altitude, droplets of water present in the atmosphere may, under certain conditions, accumulate in the form of frost on the external surfaces of the protective casing. These droplets then form a thickness of frost by accumulating on each other. This accretion of frost may make the sensor image totally unusable.

Once this frost layer is formed, and if no de-icing system is provided, this layer remains on the structure as long as the external temperature does not rise sufficiently to melt it.

The result is that a pilot may be deprived of visual access to some parts of the aircraft by reason of fogging or frost created by the accumulation of water particles on the protective glass or porthole of the camera normally used to visualize these parts.

It would therefore be valuable to have available an image acquisition device such as a video camera or a digital photographic apparatus, of which the structure prevents the formation of fogging inside or frost outside the protective casing.

Heating portholes are known in the state of the art that are made with electric wires connected to the porthole. However, these portholes are very costly and during maintenance of the acquisition device, these electric wires may be cut inadvertently during demounting, making the device ineffective.

SUMMARY

Aspects of the disclosed embodiments provide a defogging or de-icing system for an optical instrument which is simple in its design and operating mode, rapid and enabling problems of condensation and frost accumulation or fogging to be dealt with in the optical train of the image acquisition device.

Aspects of the disclosed embodiments aim at saving energy necessary for defogging or de-icing an optical instrument such as a photographic system in order to minimize consumption of electricity on board the aircraft.

To this end, the disclosed embodiments relate to defogging or de-icing an optical instrument, having a protective casing.

According to an aspect of the disclosed embodiments, this system comprises:

a porthole covered on at least one of its faces with a heat conducting film placed at the edge of the useful area of the porthole, this porthole designed to be mounted on the protective casing, heating elements designed to be placed in contact with the heat conducting film in order to heat this film, and an electrical supply circuit for these heating elements.

The conducting film and the heating elements being placed on the edge of the useful area of the porthole, this system thus makes it possible advantageously to ensure perfect control of the porthole heating while freeing the optical path to the sensor of an image acquisition device, for example so that the required image is not partly masked by one or more objects.

Purely as an illustration, this defogging or de-icing system may be employed on an image acquisition device or an optical observation device. In the latter case, the porthole is for example a lens.

In several particular embodiments of this system for defogging or de-icing an optical instrument, each having its particular advantages and being capable of numerous technical combinations:

the elements are resistances designed to cover the heat conducting film, at least partially, and of which the width and length are defined relative to the transverse dimension and which form the heat conducting film.

As an illustration, the heat conducting film having an annular form, the transverse dimension of this film is its width. The heating elements are then small-size resistances in order to take account of the annular form of the conductive film. These small dimensions of the resistances make it possible to increase the contact area with the heat conducting film, and consequently the transmission of heat. In order to distribute the temperature over a maximum area of the heat conducting film, and consequently the porthole, a large number of these resistances are employed placed against the surface of the film.

This conducting film is a heat conducting film that is mechanically deformable in order to fit onto the surfaces of the heating elements.

The film is for example deformable in that by exerting pressure on its outer surface, the original thickness of this film is compressed. Since the heating elements are pressed against this film, the film matches the surface of these heating elements, which ensures better thermal transfer of heat in the film.

The electrical supply circuit includes a printed circuit on which the heating elements are mounted, this printed circuit being designed to supply the heating elements with power, the printed circuit has an annular form.

In a more general manner, the printed circuit acting as a support for the heating elements could have any other form enabling the optical path to the sensor of an image acquisition device to be freed at its center.

It includes a temperature sensor designed to be placed near the surface of said porthole and able to generate a temperature signal.

"Near the surface" is understood to mean on the surface or at a distance permitting physical interaction with this surface so that the sensor can measure a temperature that will have been calibrated.

The system includes another heating element designed to be placed in the casing.

Purely by way of illustration, this other heating element may comprise one or more resistances mounted in parallel in order to reconcile the overall size and the power to be dissipated.

Aspects of the disclosed embodiments relate to an image acquisition device having a protective casing in which at least one sensor is placed, this casing having a porthole placed in front of the sensor.

, the device includes a defogging or de-icing system as previously described.

In a general manner, this image acquisition device may include a video camera sensor or digital photographic apparatus such as a CDD or a CMOS for acquiring images. This sensor is placed behind an objective.

Aspects of the disclosed embodiments may be employed on a protective casing of an image acquisition device designed to be mounted on an aircraft or on submarine engines for photography at great depths. In the latter case, the porthole is a spherical porthole and the protective casing is typically made of titanium. An image corrector may moreover be used for eliminating any distortions due to views taken at a wide angle.

Preferably, the protective casing is a watertight casing filled with nitrogen. The porthole is mounted on the body of the protected casing with the aid of seals ensuring that the porthole/body casing contact is watertight.

The casing may have a port for introducing nitrogen connected to a valve for controlling the nitrogen pressure and/or for filling said casing with nitrogen during maintenance operations on the ground.

Aspects of the disclosed embodiments relate to an aircraft equipped with an image acquisition device as previously described.

This defogging or de-icing system is economical and facilitates replacement of the porthole in the case of breakage since the porthole may be made of a standard glass.

BRIEF DESCRIPTION OF THE DRAWINGS

Aspects of the disclosed embodiment will be described in greater detail with reference to the appended drawings in which.

DETAILED DESCRIPTION

Figure 1:
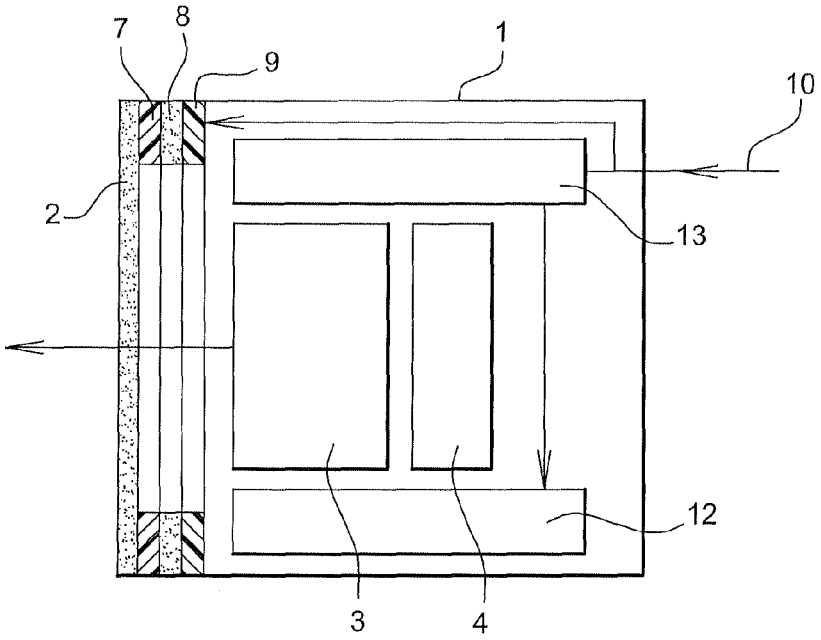
FIG. 1 is a schematic representation of an image acquisition device according to a preferred embodiment of the disclosed embodiments.
Figure 2:
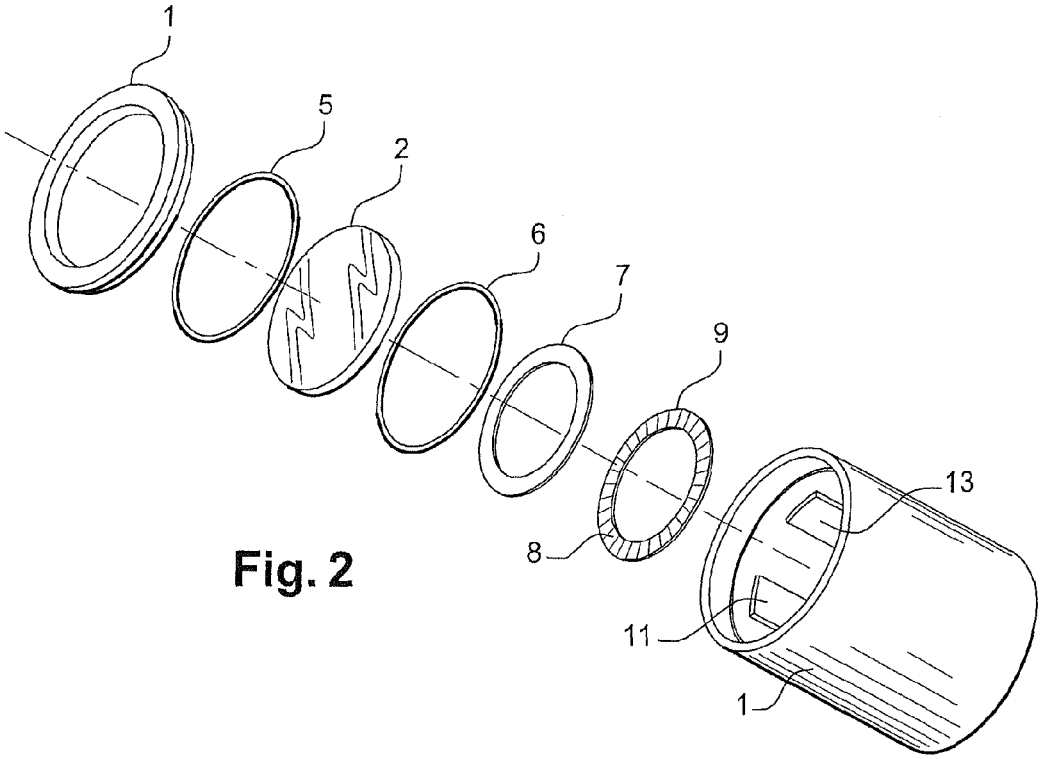
FIG. 2 is an exploded view of the device of FIG. 1.

FIG. 1 shows an image acquisition device according to a preferred embodiment of the disclosed embodiments.

This device has a protective casing 1 on which a porthole 2 is mounted. An objective 3 and a sensor 4 such as a CCD sensor having a matrix of light-detecting points are placed in this casing 1 in the direction of the light path from outside to the sensor.

The objective 3 may be an objective with a variable focal length for making enlargements of an object fixed with respect to the device.

The casing also includes a control circuit (not shown) for the sensor and its objective.

The waterproofness of the device is ensured by the seals 5, 6 interposed between the porthole 2 and the body of the protective casing 1.

The device also includes a de-icing or defogging system for the porthole 2, said porthole being covered on its inner face by a heat conducting film 7 placed on the edge of its useful area. The film has here an annular form.

This conducting film 7 advantageously comprises a substrate having glass fibers and on its outer faces layers comprising silicone polymers filled with heat conducting particles. These solid particles are preferably chosen from the group comprising alumina, graphite, boron nitride and combinations of these elements.

This heat conducting film 7 has the advantage of deforming and of enabling better heat conduction compared with a heating device without a film or with a non-deformable film for which air present between the porthole 2 and the heating elements would impair heat conduction.

The product consisting of silicone polymer layers filled with alumina on a glass fiber support, marketed under the name "Gap-Pad" (registered trade name) by the Bergquist Company, Minneapolis, United States, is particularly suitable for implementing the disclosed embodiments.

The de-icing or defogging system also includes heating elements 8 placed in contact with the heat conducting film 7 in order to heat it. These heating elements 8 that are surface-mounted resistances ("CMS") are mounted on a printed circuit 9 designed to supply these resistances with power. This printed circuit 9 is connected to the electrical supply 10 of the image acquisition device. The printed circuit 9 has an annular form so as not to interfere with the optical path to the sensor 4. Projections 11 placed on the inner wall of the casing 1 serve to support the printed circuit 9 while enabling the resistance 8 to be pressed onto the heat conducting film 7.

The arrangement of these resistances 8, i.e. flat on the crown formed by the printed circuit 9, provides a maximum contact surfaces of the resistances 8 with the heat conducting film 7, in this way facilitating heat transmission.

The resistance 8 are here soldered onto the crown of the printed circuit 9 with the aid of a high-temperature (typically of the order of 350° C.) solder, in order to prevent accidental detachment of these resistances 8 during the temperature rise.

The defogging or de-icing system also includes another heating element 12 placed inside the casing 1 and connected to the electrical supply 10 of the image acquisition device via a thermostat 13. This other heating element 12 is of the power resistance type.

This other heating element 12 controlled by the thermostat 13 advantageously enables a positive temperature to be maintained inside the casing 1 and in this way improves the efficiency of de-icing performed by the heating elements 8 in contact with the heat conducting film 7.

In a particular embodiment of the disclosed embodiments, the porthole is made of a quite standard glass of thickness 2.5 mm and has a diameter of 60 mm. The surface-mounted resistances 8 have dimensions of the order of 3 mm×2 mm×1 mm and have limited individual power (0.25 W per resistance).

The number of resistances 8 mounted on the crown-shaped printed circuit 9, fifty for example, makes it possible to obtain the total power necessary for heating the porthole 2 in a reduced space.

The energy dissipation is more suited to the diameter of the porthole 2. The 50 resistances of 0.25 W lead to a dissipation of 0.2 W per $cm^2$ of porthole 2.

The other heating element 12 is calculated to have a power of 0.05 $W/cm^3$. In the case of a protective casing 1, 100 mm long and 60 mm in diameter, the other heating element 12 has then a power of 6 Watts. It may thus consist of four resistances made of pure ceramic of 510 ohms each, which are put in parallel in order to reconcile the overall size and power to be dissipated.

The thermostat 13 is of the open contact type. The supply 10 is a low voltage supply, 28 volts, generally used in aircraft.

The invention claimed is:

1. A defogging or de-icing system for an optical instrument having a protective casing, wherein the defogging or de-icing system comprising:

a porthole mounted on the protective casing;

a plurality of heating elements;

a compressible, annular heat conducting film placed at an edge of the porthole and conforming to a shape of the heating elements when compressed between the edge of the porthole and the plurality of heating elements; and an electrical supply circuit for said heating elements.

2. The system as claimed in claim 1, wherein said conducting film comprises a substrate having glass fibers and on its outer faces layers comprising silicone polymers filled with heat conducting particles.

3. The system as claimed in claim 1, wherein said electrical supply circuit includes a printed circuit on which the heating elements are mounted, said printed circuit being designed to supply said heating elements with power.

4. The system as claimed in claim 3, wherein said printed circuit has an annular form.

5. The system as claimed in claim 1, wherein said heating elements are resistances designed to at least partially cover said heat conducting film.

6. The system as claimed in claim 1, further comprising another heating element designed to be placed in said casing.

7. An image acquisition device having a protective casing in which at least one sensor is placed, said casing having a porthole placed in front of the sensor, the image acquisition device further comprising a defogging or de-icing system as claimed in claim 1.

8. The device as claimed in claim 7, wherein said casing is a watertight casing filled with nitrogen.

9. An aircraft equipped with an image acquisition device as claimed in claim 7.

* * * * *